US011312516B2

(12) United States Patent
Zhao et al.

(10) Patent No.: US 11,312,516 B2
(45) Date of Patent: Apr. 26, 2022

(54) ENTITY POSITIONING AND SUPPORTING MECHANISM FOR CLOSING SIDE TONGUES OF A FULL-AUTOMATIC PACKAGING MACHINE FOR FLEXIBLE MATERIALS

(71) Applicant: Shanghai Weishili Machinery Technology Co., Ltd., Shanghai (CN)

(72) Inventors: Libang Zhao, Zhengzhou (CN); Heng Zhao, Zhengzhou (CN); Jinzhong Huang, Zhengzhou (CN); Guoxing Niu, Shanghai (CN); Wubo Wang, Luohe (CN); Yidong Wang, Chongqing (CN)

(73) Assignee: SHANGHAI WEISHILI MACHINERY TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 17/355,582

(22) Filed: Jun. 23, 2021

(65) Prior Publication Data

US 2022/0009655 A1 Jan. 13, 2022

(30) Foreign Application Priority Data

Jul. 7, 2020 (CN) ..... 202010645255.9

(51) Int. Cl.
*B65B 7/16* (2006.01)
*B65B 7/24* (2006.01)

(52) U.S. Cl.
CPC ..... *B65B 7/24* (2013.01)

(58) Field of Classification Search
CPC ..... B65B 7/20; B65B 43/46
See application file for complete search history.

(56) References Cited

U.S. PATENT DOCUMENTS 5,022,214 A * 6/1991 Kim ..... B65B 7/20 53/376.4
5,115,625 A * 5/1992 Barbulesco ..... B65B 7/20 53/284
5,454,776 A * 10/1995 Ulrich ..... B65B 7/20 493/183
6,070,396 A * 6/2000 Rinaldi ..... B65B 7/20 493/23
6,306,070 B1 * 10/2001 Herrin ..... B31B 50/00 493/125
10,183,798 B2 * 1/2019 Berthault ..... B65D 81/3453
11,220,080 B2 * 1/2022 Iwasa ..... B65B 5/106

* cited by examiner

*Primary Examiner* — Andrew M Tecco
(74) *Attorney, Agent, or Firm* — WPAT, PC

(57) ABSTRACT

An entity positioning and supporting mechanism for closing side tongues of a box of a full-automatic packaging machine for flexible materials, comprising retractable positioning baffle mechanisms and retractable pressing head mechanisms respectively installed symmetrically on both sides of a box conveying passage of the main body of the packaging machine, a lifting entity supporting insertion plate mechanism provided on an upper portion of the main body of the packaging machine, a lifting oblique pushing mechanism located at the bottom of the box conveying passage; wherein said retractable positioning baffle mechanism is composed of a retractable positioning baffle having guide rods and a linear moving unit of the retractable positioning baffle.

4 Claims, 4 Drawing Sheets

ENTITY POSITIONING AND SUPPORTING MECHANISM FOR CLOSING SIDE TONGUES OF A FULL-AUTOMATIC PACKAGING MACHINE FOR FLEXIBLE MATERIALS

FIELD OF THE INVENTION

The present application relates to a full-automatic packaging machine, in particular to the entity positioning and supporting for closing side tongues of the box after packaging with flexible, irregular, and highly compressible materials (including disposable gloves and masks, protective clothing made from PVC, nitrile, latex and other materials). The entity supporting is functioned to accurately position the box body and the side tongues. It is the most critical mechanism to ensure the success of the closing side tongues, and it is important in the stability and rate of success for closing side tongues of the automatic packaging machine; and it is the key mechanism to determine whether the entire automatic packaging machine is stable.

BACKGROUND OF THE INVENTION

At present, the existing automatic packaging machines in the market are almost only suitable for the processed secondary semi-hard materials such as rigid or compressed with regular appearance. For these materials, traditional sealing methods such as lock, adhesive, and positive sealing can be used. However, for those flexible objects such as disposable gloves, masks, protective clothing, etc., it has great resilience and expansion when using traditional sealing methods which can easily cause the deformation and damage of the box during the transportation, affecting the quality and the appearance thereof. Export products must undergo random inspections by the customs before they can be released. The traditional sealing method can only perform destructive disassembly and inspection, which wastes qualified goods. If the internal side tongues are buckled and the external upper and lower lids are buckled together, it not only solves the problem that the box can be restored to deformation without being damaged by moderate squeezing during the transportation, but also facilitates customs inspections without destroying the finished box when exporting. The Chinese Patent No. CN08053757U disclosed an automatic packaging robot for latex glove boxes, comprising the systematic working steps of a traditional automatic packaging machine. A brief description for the principle of the closing side tongues is given, but there is no specific mechanism to achieve the purpose. Several domestic automatic packaging machines have been developed according to their principles for a long time but still cannot solve the problem of the stability of the closing side tongues. Therefore, there is no such mature product for use in the domestic market, and the manual packaging is still the main method.

SUMMARY OF THE INVENTION

The purpose of the present invention is to provide an entity positioning and supporting mechanism for closing the side tongues of the box used in a full-automatic packaging machine for flexible materials in view of the above-mentioned shortcomings in the prior art.

The purpose of the present invention can be achieved by the following steps:

The automatic packaging machine for flexible materials according to the present invention includes a main body of the packaging machine, a retractable positioning baffle mechanisms and a retractable pressing head mechanism respectively installed symmetrically on both sides of the box conveying passage of the main body of the packaging machine, and a lifting entity supporting insertion plate mechanism provided on an upper portion of the main body of the packaging machine, a lifting oblique pushing mechanism located at the bottom of the box conveying passage; the retractable positioning baffle mechanisms is composed of a retractable positioning baffle having guide rods and a linear moving unit of the retractable positioning baffle for driving the retractable positioning baffle having guide rods for a horizontal telescopic movement; the lifting entity supporting insertion plate mechanism is composed of a transitional connecting member of the lifting entity supporting insertion plate driven to move up and down by a linear moving unit of the lifting entity supporting insertion plate and arranged transversely, and lifting entity supporting insertion plates respectively provided at both ends of the transitional connecting member of the entity supporting insertion plate in a symmetrical manner and at least one of which is extended vertically in downward, and the distance between the lifting entity supporting insertion plates at both ends of a cross member is matched with the length of the box (wherein the function thereof is: i. continuously positioning the box that has been positioned before by the retractable positioning baffle (retracted); ii. when the lifting entity supporting insertion plate is lowered and inserted between the body of the box and side tongues, the inner side thereof locating the body of the box and the outer side thereof has a certain angle, when the retractable positioning pressing head slightly presses side tongues to the outer surface thereof, the angle formed by fitting the left and right side tongues is just allowed the slot of the side tongues to form an accurate break joint, and when the box is twisted back from rhomb to square, the slots of the left and right side tongues are just buckled successfully); said retractable pressing head mechanism is constituted by a pressing and positioning head having low friction coefficient (made of metal or non-metal low-friction material), a transitional connection plate of the pressing head connecting with the pressing and positioning head through a micro-adjusting screw rod, and a linear moving unit of the retractable pressing head mechanism combined with the outside of the transitional connection plate of the pressing head for driving the positioning head to achieve a horizontal telescopic movement (the functions thereof are: i. to accurately press the left and right side tongues (when extended out) onto the angle surface of the entity supporting insertion plate, and, ii. in that the lower head folds and presses the lower cover of the box so that it cannot interfere with the staggered left and right side tongues when lifting and pushing obliquely the box).

Furthermore, in the present invention, two ends of the transitional connecting member of the lifting entity supporting insertion plate are respectively provided with a front and a rear vertically downwardly extending lifting entity supporting insertion plates corresponding to the front and rear box stations in a symmetrical arrangement. The supporting insertion plate (that is, two boxes are continuously positioned synchronously every time), and the cross section of the lifting entity supporting insertion plate has a folded plate structure with both sides thereof being bent inward, and the plate angle is 150°~178°.

In the present invention, the retractable positioning baffle mechanism is symmetrically arranged at two ends of the position for closing the side tongues of the box (both sides of the box conveying passage), to accurately locate the box before and after closing the side tongues of the box. The main functions of the retractable baffle mechanism are in that: i. the upper cover of the conveyed box is automatically folded up by an upper guide rod during conveying and arrived in the inner side of the upper lifting entity supporting insertion plate; ii. the body of the box arrived at the position for closing the side tongues is accurately located (under an extended state), so as to allow every arrived box to be located at a central position for closing side tongues; iii. after the box is in place, the baffle is retracted, and the side tongues are opened at a certain angle to open a space for receiving the upper lifting entity supporting insertion plate (descent of the lifting entity supporting insertion plate); iv. when the box is rising, the lower guide rod of the baffle is retracted, and the lower cover of the box has a pre-folded angle to prevent the lower cover of the box from tearing the connection with the body after the pressing head is quickly extended in the next step; v. after the closing of the side tongues is completed, the positioning baffle is extended out again to make the box to be conveyed to the subsequent station after centering.

Advantageous effects of the present invention are as follows:

a. The accurate positioning of the body of the box is realized by the retractable positioning baffle mechanisms located at both ends of the body of the box (both sides of the box conveying passage), which eliminates the error generated during the movement of the box, and it is important for the successfully closing the tongues of the box.

b. The continuous positioning and the setting angle (150-178° is set according to the box size and the packed product) of the upper lifting entity supporting insertion plate solves problems of the change of the angle of the break joint of the left and right side tongues and the inaccurate control. The efficiency and stability for closing the side tongues have been greatly improved.

c. Since the retractable pressing head mechanisms located at both ends of the body of the box (both sides of the box conveying passage) adopts low friction coefficient materials and micro-adjusting screw rod, an accurate adjustment for the friction force between the side tongues and the lifting entity supporting insertion plate is realized and to make the buckling of tongues more stable and successful.

In summary, the entity positioning supporting for closing side tongues of the present invention completely solves the historical problems of low efficiency and low stability of closing the left and right side tongues when flexible materials are automatically packed. It has the advantages of simple structure, convenient maintenance and operation, precise adjustment, non-easily damaged the contents within the box, etc., and it is the key point to have a strong stability and so on. It is the vital technical mechanism for the real stable operation of the automatic packaging machine for flexible materials. It provides technical support for the rapid launch of mature and stable automatic packaging machines for flexible materials.

Figure 1:
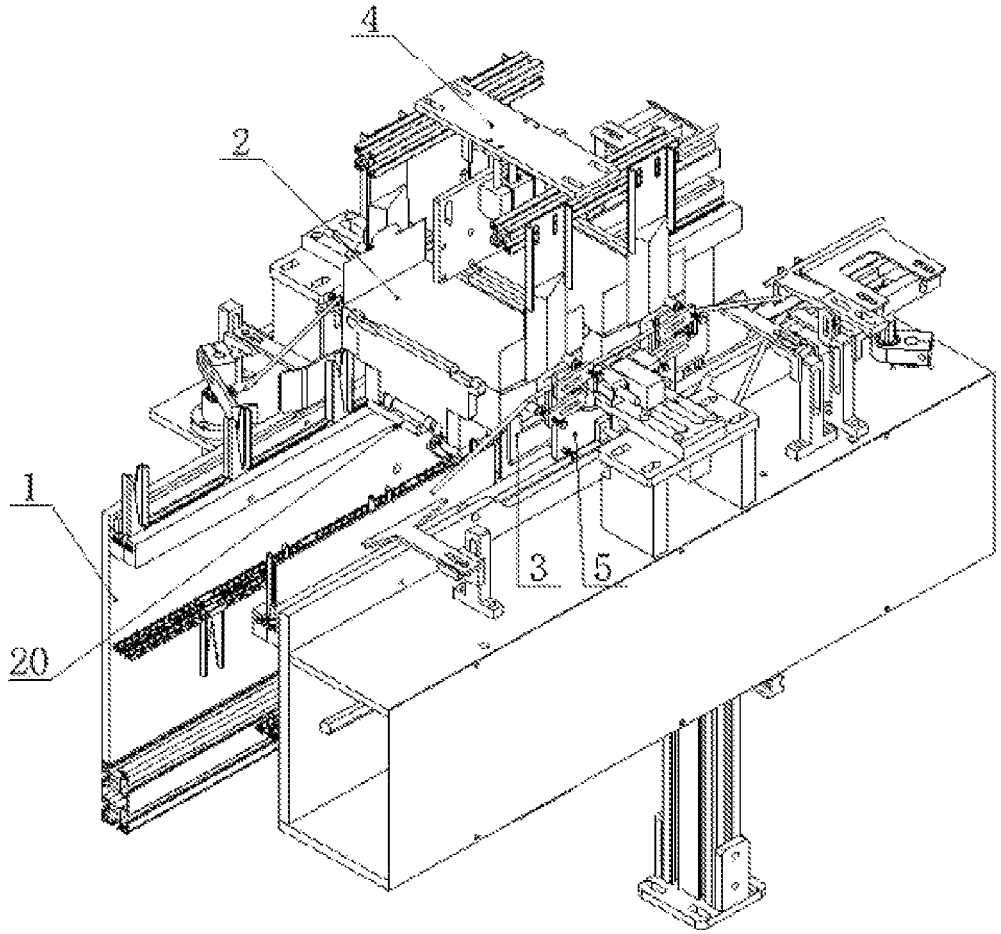
FIG. 1 is an isometric perspective structural view shown that the full-automatic packaging machine for packaging flexible materials and the entity positioning and supporting mechanism for closing side tongues are assembled together.

The references numbers in the figures: 1—a main body of the packaging machine, 2—a box, 3—a retractable positioning baffle mechanism, 4—a lifting entity supporting insertion plate mechanism, 5—a retractable pressing head mechanism, 6—a retractable positioning baffle having guide rods, 7—a linear moving unit of the retractable positioning baffle, 8—a fixed seat of the linear motion unit, 9—a lifting entity supporting insertion plate, 10—a transitional connecting member of the lifting entity supporting insertion plate, 11—a linear moving unit of the lifting entity supporting insertion plate, 12—a transitional connecting plate of the pressing head, 13—a pressing and positioning head, 14—a micro-adjusting screw rod, 15—a linear moving unit of the retractable pressing head mechanism, 16—a left tongue of the box, 17—a right tongue of the box, 18—an upper cover of the box, 19—a lower cover of the box, and 20—a lifting oblique pushing mechanism.

DETAILED DESCRIPTION OF THE EMBODIMENTS

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

Figure 2:
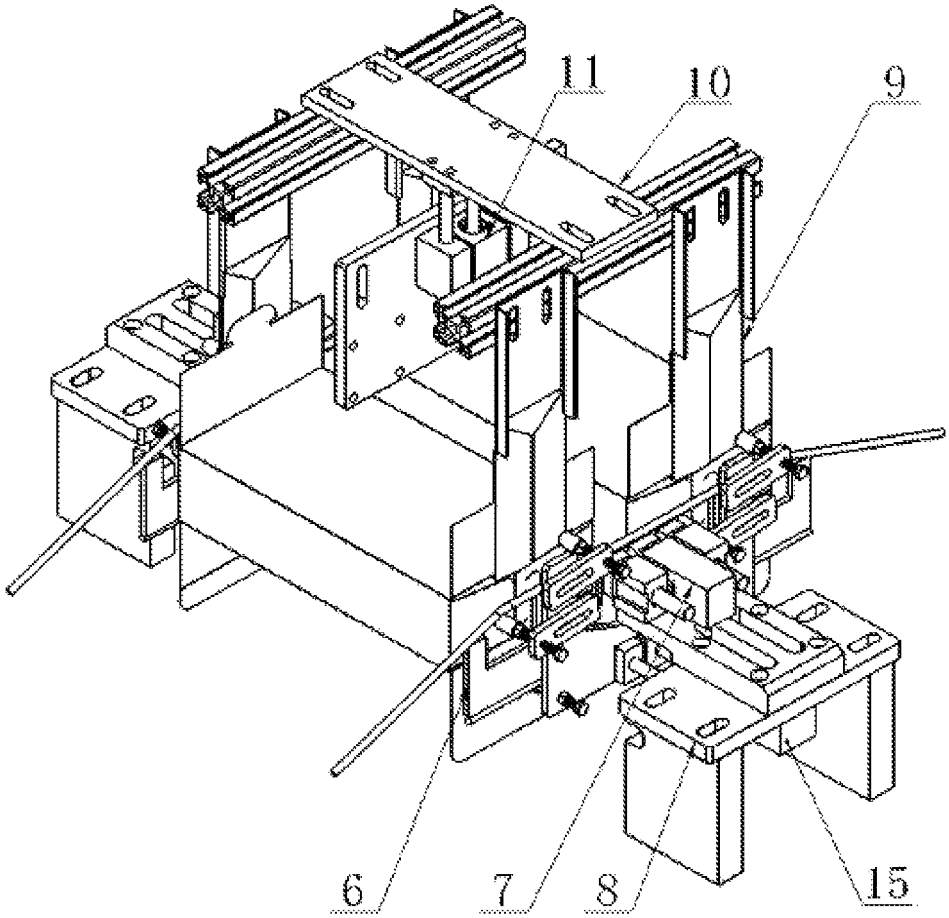
FIG. 2 is an isometric perspective structural view of the entity positioning and supporting mechanism for closing side tongues.
Figure 3:
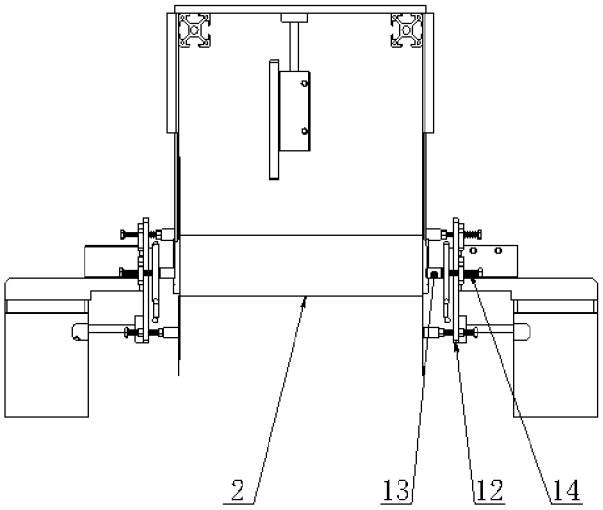
FIG. 3 is a front structural view of FIG. 2.
Figure 4:
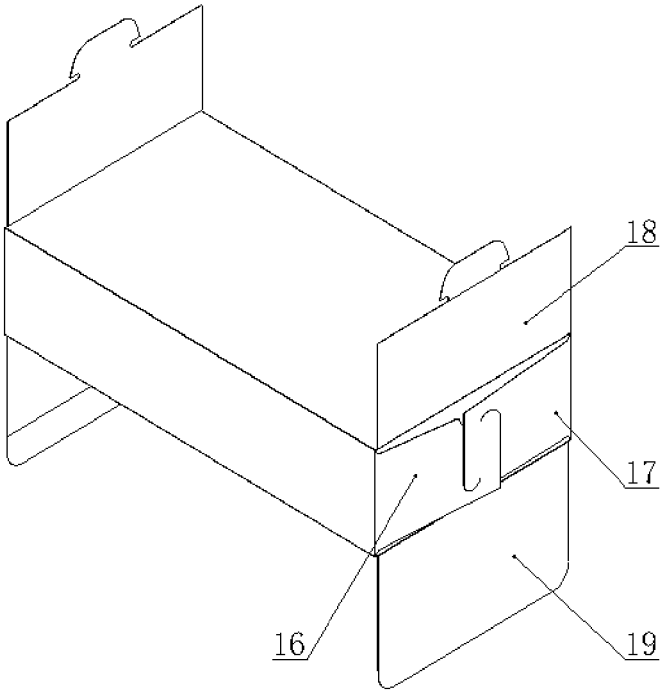
FIG. 4 is an isometric perspective view of the box structure.

The present invention will be further described below in conjunction with embodiments (figures):

As shown in FIGS. 1, 2, and 3, the automatic packaging machine for flexible materials according to the present invention includes a main body of the packaging machine 1, a retractable positioning baffle mechanisms 3 and a retractable pressing head mechanism 5 respectively installed symmetrically on both sides of the box conveying passage of the main body of the packaging machine, and a lifting entity supporting insertion plate mechanism 4 provided on an upper portion of the main body of the packaging machine, a lifting oblique pushing mechanism 20 located at the bottom of the box conveying passage; the retractable positioning baffle mechanisms 3 is composed of a retractable positioning baffle having guide rods 6 and a linear moving unit of the retractable positioning baffle 7 for driving the retractable positioning baffle having guide rods for a horizontal telescopic movement; the lifting entity supporting insertion plate mechanism 4 is composed of a transitional connecting member of the lifting entity supporting insertion plate 10 driven to move up and down by a linear moving unit of the lifting entity supporting insertion plate 11 and arranged transversely, and lifting entity supporting insertion plates 9 respectively provided at both ends of the transitional connecting member of the entity supporting insertion plate 10 in a symmetrical manner and at least one of which is extended vertically in downward, and the distance between the lifting entity supporting insertion plates 9 at both ends of a cross member is matched with the length of the box (wherein the function thereof is: i. continuously positioning the box that has been positioned before by the retractable positioning baffle (retracted); ii. when the lifting entity supporting insertion plate is lowered and inserted between the body of the box and side tongues, the inner side thereof locating the body of the box and the outer side thereof has a certain angle, when the retractable positioning pressing head slightly presses side tongues to the outer surface thereof, the angle formed by fitting the left and right side tongues is just allowed the slot of the side tongues to form an accurate break joint, and when the box is twisted back from rhomb to square, the slots of the left and right side tongues are just buckled successfully); said retractable pressing head mechanism 5 is constituted by a pressing and positioning head 13 having low friction coefficient (made of metal or non-metal low-friction material), a transitional connection plate of the pressing head 12 connecting with the pressing and positioning head 13 through a micro-adjusting screw rod 14, and a linear moving unit of the retractable pressing head mechanism 15 combined with the outside of the transitional connection plate of the pressing head 12 for driving the positioning head to achieve a horizontal telescopic movement (please refer to FIG. 3). The functions of the retractable pressing head mechanism are: i. to accurately press the left and right side tongues (when extended out) onto the angle surface of the entity supporting insertion plate, and, ii. in that the lower head folds and presses the lower cover of the box so that it cannot interfere with the staggered left and right side tongues when lifting and pushing obliquely the box.

Figure 5:
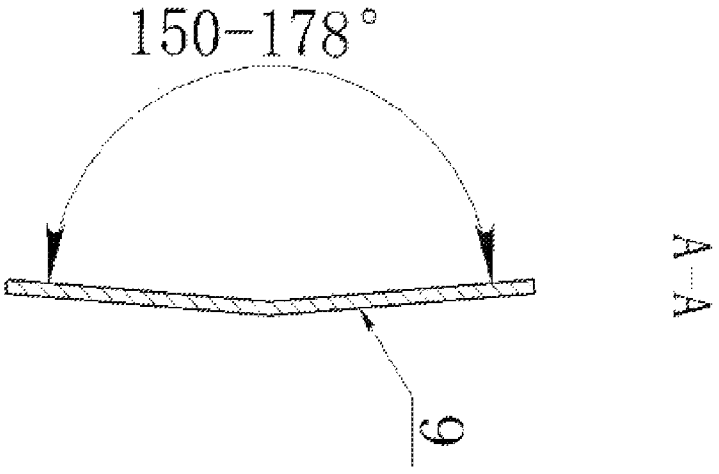
FIG. 5 is a cross-sectional view of the lifting entity supporting insertion plate.

Furthermore, in the present invention, two ends of the transitional connecting member of the lifting entity supporting insertion plate 10 are respectively provided with a front and a rear vertically downwardly extending lifting entity supporting insertion plates corresponding to the front and rear box stations in a symmetrical arrangement. The supporting insertion plate 9 (that is, two boxes are continuously positioned synchronously every time), and the cross section of the lifting entity supporting insertion plate 9 has a folded plate structure with both sides thereof being bent inward, and the plate angle is 150°~178° (see FIG. 5).

Figure 6:
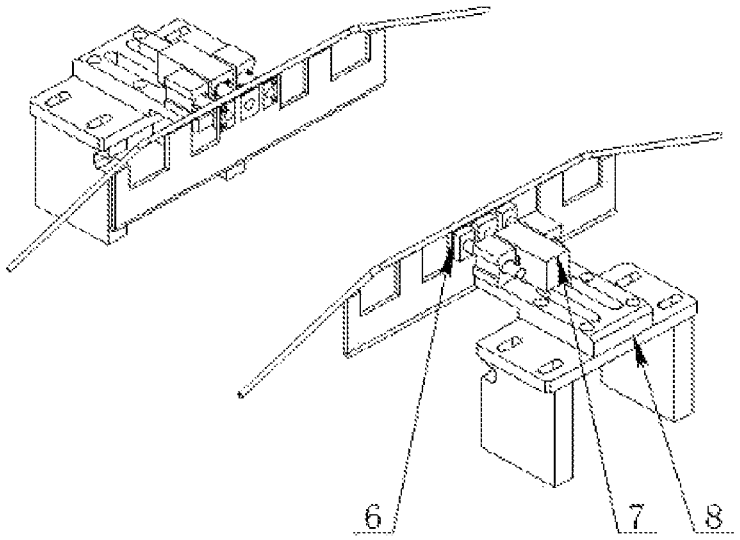
FIG. 6 is a schematic structural view of a retractable positioning baffle mechanism.

As shown in FIG. 6, the retractable positioning baffle mechanism 3 in the present invention is symmetrically arranged at two ends of the position for closing the side tongues of the box (both sides of the box conveying passage), to accurately locate the box before and after closing the side tongues of the box. The main functions of the retractable baffle mechanism are in that: i. the upper cover of the conveyed box is automatically folded up by an upper guide rod during conveying and arrived in the inner side of the upper lifting entity supporting insertion plate; ii. the body of the box arrived to the position for closing the side tongues is accurately located (under an extended state), so as to allow every arrived box to be located at a central position for closing side tongues; iii. after the box is in place, the baffle is retracted, and the side tongues are opened at a certain angle to open a space for receiving the upper lifting entity supporting insertion plate (descent of the lifting entity supporting insertion plate); iv. when the box is rising, the lower guide rod of the baffle is retracted, and the lower cover of the box has a pre-folded angle to prevent the lower cover of the box from tearing the connection with the body after the pressing head is quickly extended in the next step; v. after the closing of the side tongues is completed, the positioning baffle is extended out again to make the box to be conveyed to the subsequent station after centering.

The specific working sequence and steps of the present invention are as follows:

1). the box is delivered to the entity positioning and supporting site for closing side tongues through the conveyor chain of the packaging machine; during this process, both ends of the retractable positioning baffle mechanism 3 is under an extended state to accurately align the box in the center; the upper cover 18 of the box is folded upwardly along the upper guide rod of the retractable positioning baffle having guide rods 6 from a horizontal state to a 90° vertical state automatically, and just travels to the inner side of the lifting entity supporting insertion plate 9, which is continuously positioned by the lifting entity supporting insertion plate;

2). the retractable positioning baffle having guide rods 6 is retracted under the drive of the linear moving unit of the retractable positioning baffle 7, the left tongue 16 of the box and the right tongue 17 of the box are opened to a certain angle by taking such opportunity, and then the lifting entity supporting insertion plate 9 on the left side is descended and inserted between the left tongue 16 of the box and the right tongue 17 of the box by the drive of the linear moving unit of the lifting entity supporting insertion plate 11;

3). the paper box 2 is raised by the lifting of the lifting and oblique pushing mechanism 20, during this process, the lifting entity supporting insertion plate 9 on the right side continuously locates the box; the retracted retractable positioning baffle having guide rods 6 also continuously positions the left side tongue 16 of the box and the right side tongue 17 of the box to prevent them from opening too much and affecting the subsequent pressing step; the lower cover 19 of the box is folded downwardly to form an angle by the lower guide rod of the retractable positioning baffle having guide rods;

4). after the box is lifted in place, the box forms a diamond shape under the oblique push by the lifting oblique pushing mechanism 20;

5). after the box is obliquely pushed in place, the pressing and positioning head 13 is extended out by the linear moving unit of the retractable pressing head mechanism 15, and the left side tongue 16 and the right side tongue 17 of the box are respectively pressed onto the left and right angled surfaces the lifting entity supporting insertion plate 9, the slots of the left side tongue and the right side tongue form an accurate buckling break joint, and the pressing force is adjusted to the best strength through the micro-adjusting screw rod 14;

6). the box is twisted back to a square shape by the twisting of the lifting oblique pushing mechanism 20, and the slots of the left side tongue and the right side tongue are accurately buckled;

7). When the lifting entity supporting insertion plate mechanism 4 is raised, the lifting oblique pushing mechanism 20 is descended and the box 2 is dropped to a position on the conveying track of the main body of the packaging machine 1;

8). the retractable positioning baffle mechanism is extended out again, and the box that has been buckled with the side tongues is positioned in center again, and then is delivered to the next working station.

What is claimed is:

1. An entity positioning and supporting mechanism for closing side tongues of a box of a full-automatic packaging machine for flexible materials, characterized in that:

the positioning and supporting mechanism comprises: a main body of the packaging machine, retractable positioning baffle mechanisms and retractable pressing head mechanisms respectively installed symmetrically on both sides of a box conveying passage of said main body of the packaging machine, a lifting entity supporting insertion plate mechanism provided on an upper portion of the main body of the packaging machine, a lifting oblique pushing mechanism located at the bottom of the box conveying passage;

said retractable positioning baffle mechanism is composed of a retractable positioning baffle having guide rods and a linear moving unit of the retractable positioning baffle for driving said retractable positioning baffle having guide rods for a horizontal telescopic movement;

said lifting entity supporting insertion plate mechanism is composed of a transitional connecting member of the lifting entity supporting insertion plate driven to move up and down by a linear moving unit of the lifting entity supporting insertion plate and arranged transversely, and lifting entity supporting insertion plates respectively provided at both ends of the transitional connecting member of the entity supporting insertion plate in a symmetrical manner and at least one of which is extended vertically in downward, and a distance between the lifting entity supporting insertion plates at both ends of a cross member is matched with the length of the box;

said retractable pressing head mechanism is constituted by a pressing and positioning head having low friction coefficient, a transitional connection plate of the pressing head connecting with the pressing and positioning head through a micro-adjust screw rod, and a linear moving unit of the retractable pressing head mechanism combined with the outside of the transitional connection plate of the pressing head for driving the positioning head to achieve a horizontal telescopic movement.

2. The entity positioning and supporting mechanism for closing side tongues of a box of a full-automatic packaging machine for flexible materials according to claim 1, characterized in that: two ends of the transitional connecting member of the lifting entity supporting insertion plate are respectively provided with a front and a rear vertically downwardly extending lifting entity supporting insertion plates corresponding to the front and rear box stations in a symmetrical arrangement.

3. The entity positioning and supporting mechanism for closing side tongues of a box of a full-automatic packaging machine for flexible materials according to claim 1, characterized in that: said retractable positioning baffle mechanism is symmetrically arranged at two ends of a position for closing the side tongues of the box, so as to accurately position the box before and after closing the side tongues of the box.

4. The entity positioning and supporting mechanism for closing side tongues of a box of a full-automatic packaging machine for flexible materials according to claim 1, characterized in that: the cross section of said lifting entity supporting insertion plate has a folded plate structure with both sides thereof being bent inward, and the plate angle is 150°~178°.

* * * * *